United States Patent [19]

Fisher

[11] 4,304,531

[45] Dec. 8, 1981

[54] HIGH PRESSURE PISTON PUMPS

[75] Inventor: Martin J. Fisher, Bletchley, England

[73] Assignee: British Hydromechanics Research Assoc., Bedford, England

[21] Appl. No.: 155,598

[22] Filed: Jun. 2, 1980

Related U.S. Application Data

[63] Continuation of Ser. No. 933,184, Aug. 14, 1978, abandoned.

[30] Foreign Application Priority Data

Aug. 19, 1977 [GB] United Kingdom ..... 34969/77

[51] Int. Cl.[3] ..... F04B 9/10

[52] U.S. Cl. ..... 417/388; 417/383; 417/390

[58] Field of Search ..... 417/383, 385, 386, 387, 417/388, 390

[56] References Cited

U.S. PATENT DOCUMENTS

| | | | |
|---|---|---|---|
| 2,497,300 | 2/1950 | Elliot | 417/388 |
| 2,624,284 | 1/1953 | Straub | 417/388 |
| 3,790,310 | 2/1974 | Whelan | 417/388 |

FOREIGN PATENT DOCUMENTS

| | | | |
|---|---|---|---|
| 272374 | 6/1927 | United Kingdom | 417/388 |
| 486142 | 1/1976 | U.S.S.R. | 417/387 |

*Primary Examiner*—Leonard E. Smith
*Attorney, Agent, or Firm*—Irvin A. Lavine

[57] ABSTRACT

A high-pressure piston pump in which a low-viscosity working liquid supplied at a first pressure is delivered at a second, ultra-high pressure of, typically, up to 4,000 bars, for use in jet cutting and cleaning operations comprises a cylinder enclosing a first variable volume chamber for a viscous, operating liquid between a main piston and a subsidiary piston, and a second variable volume chamber for the working liquid, between the subsidiary piston and the head end of the cylinder. Operating liquid which leaks from the first chamber during working strokes of the pump and which thus reduces the volume of liquid in the first chamber, is replaced through a non-return valve in the main piston during non-working strokes as a result of the reduction in pressure in the first chamber. The subsidiary piston is provided with a coupling engageable with the main piston for limiting movement of the main piston away from the subsidiary piston during non-working strokes of the pump. This prevents excess operating liquid from flowing into the first chamber while ensuring that the first chamber is completely filled at the commencement of each working stroke with the operating liquid at an intermediate pressure between said first and second pressures.

4 Claims, 3 Drawing Figures

HIGH PRESSURE PISTON PUMPS

CROSS REFERENCE TO RELATED APPLICATION

This application is a continuation of application Ser. No. 933,184 filed Aug. 14, 1978, now abandoned.

TECHNICAL FIELD

This application relates to high pressure piston pumps which are used primarily to provide high pressure fluid for liquid jet cutting and jet cleaning operations. Pressures of up to and exceeding 4,000 bars are required and the liquids used can frequently be of low viscosity—typically water—and may contain particulate suspensions or additives so as to form slurries.

BACKGROUND ART

Elastomeric, fibre bonded or leather seals are rarely satisfactory in such conditions because it is difficult to lubricate the sliding surfaces satisfactorily and at the same time prevent the seal material being extruded into the clearance between the piston and the cylinder bore. The combination of high pressure and low viscosity tends to bring about early or even immediate failure of the seal.

Piston rings can overcome the extrusion problem, but require better lubrication than provided by the commonly used fluids in high pressure jet applications.

An alternative approach has been to use a closely fitting piston without special seals. In this method, the clearance between piston and cylinder bore has to be closely controlled and materials carefully selected to ensure adequate lubrication. With low viscosity fluids, the axial length for which the close clearance must be maintained is considerable if the leakage is to be kept within acceptable limits. The combined requirement of a very small radial clearance between piston and cylinder bore and its maintenance for a considerable length results in high costs of manufacture and bulky equipment.

A well known technique for overcoming this problem is to use a supply of good lubricating and easily sealed fluid, typically an oil, which is introduced into the machine in the vicinity of the seals so that the seals operate with this good lubricating fluid.

One form of this well known technique is to use two seals on a single piston and to feed a viscous liquid, such as oil, into the cavity between the two seals. The pressure of the oil feed is arranged to be equal to or greater than the pressure reached by the lower viscosity liquid, such as water, so that the seal separating the cavity from atmosphere only operates with oil and, as the pressure of the water in the inner part of the cylinder never exceeds the pressure of the oil in the cavity, the seal separating the cavity from the inner part of the cylinder never operates with the water and hence the oil always lubricates both seals.

The disadvantage of this method is that a separate supply of oil at a pressure equal to or greater than the output pressure of the water pump is required.

In another form of high pressure piston pump, oil is feed into the bore so that it remains in the vicinity of the seal on a main piston and consequently this seal is lubricated with oil. A subsidiary piston is used to provide a physical separator between the oil and water. The pressure drop across this separator is very small, being only that required to overcome the friction and inertia of the subsidiary piston. During the operation of the pump, oil leaks past the seal on the main piston at an indeterminate rate and provision must be made to make up this loss. The volume of oil in the bore of the pump, between the main and subsidiary pistons, needs to be controlled for satisfactory operation. If it were to become too small, the subsidiary piston would contact the main piston and the full water pressure would be developed across the separator. If it were to become too large, as a result of a reverse pressure differential across the subsidiary piston during non-delivery strokes of the main piston, the subsidiary piston would be driven to the end of the cylinder before the main piston had completed its delivery stroke.

DISCLOSURE OF THE INVENTION

It is, therefore, an object of the present invention to provide means for overcoming the deficiencies encountered when adopting known techniques. Thus it is the primary object of the invention to provide a high pressure piston pump with means for continuously compensating for leakage of an auxiliary fluid employed for sealing purposes.

According to the invention, there is provided a high pressure piston pump comprising a cylinder, a main piston drivably reciprocable within a first, open end of the cylinder, a subsidiary piston disposed between the main piston and an opposite, head end of the cylinder so as to serve as a separator which divides the cylinder into first and second variable volume chambers respectively provided adjacent the first piston and adjacent the head end of the cylinder for a first operating liquid and a second working liquid of respectively higher and lower viscosities, first and second sealing means respectively provided between the main piston and the open end of the cylinder and between the subsidiary piston and the bore of the cylinder, lost motion coupling means connecting the main and subsidiary pistons so as to permit the main piston to move towards the subsidiary piston as the main piston moves towards the head end of the cylinder and to move away from the subsidiary piston, by a limited amount, during movement of the main piston away from the head end of the cylinder, and a conduit provided with non-return means for supplying operating liquid to the first chamber at an intermediate pressure between the supply and discharge pressures of the working liquid when the pressure in the first chamber falls below said intermediate pressure, the first and second sealing means being respectively capable of controlling leakage of the operating liquid from the cylinder and of restricting flow of the operating and working liquids between the subsidiary piston and the bore of the cylinder.

Thus, a precisely controlled volume of operating liquid is provided between the main and subsidiary pistons at the beginning of each working stroke of the main piston without using a supply of said operating liquid having a pressure which is at least equal to the discharge pressure of the lower viscosity working liquid.

In operation of a pump such as this, the head end of the cylinder is connected between inlet and outlet ends of a supply line respectively provided with non-return valves for the working liquid of lower viscosity.

The construction of a high pressure piston pump, in accordance with the invention, is particularly suitable where the inlet end of the supply line for the working liquid is connected to a source of working liquid which is not pressurised sufficiently to move the subsidiary piston away from the head end of the cylinder, on reverse movement of the main piston.

Conveniently, the conduit provided with non-return means for supplying operating liquid to the first chamber, when the pressure in the first chamber falls below the intermediate pressure, maybe communicatively connected to the first chamber through an opening in the bore of the cylinder. The conduit may alternatively pass through the main piston itself, an arrangement which is especially convenient if the main piston is driven by linear hydraulic actuators when the operating fluid may be the same as that driving the hydraulic actuator.

A high pressure piston pump according to the invention therefore operates with a delivery stroke in which the higher viscosity operating liquid is pressurised and transmits this pressure via the subsidiary piston to the lower viscosity working liquid which is being pumped. On the return stroke, the subsidiary piston follows the main piston because the subsidiary piston is mechanically retracted, as hereinbefore described. Unless special precautions are taken, there is an interruption in the delivery of the pressurised lower viscosity working liquid during the period of retraction.

To avoid undue fluctuation in discharge, high pressure piston pumps are commonly arranged in pairs which operate with 180° phase difference between them. With this arrangement, two supply lines are provided for the working liquid to be pumped, one to each of the piston cylinder pumps, and these feed the working liquid via inlet check valves, one in each line. The working liquid delivered by the pumps cannot return to the supply and consequently is passed through the delivery check valves, again provided one to each pumping unit. This second pair of check valves prevents pressurised working liquid from returning to the pumps during their retraction. Finally, the two delivery lines are joined to form a common delivery point. In this way, each pump can be charged whilst the other is discharging and it becomes possible to obtain an uninterrupted discharge.

The main pistons can be driven in a number of ways including conventional crank arrangements. One preferred arrangement is to use two double-acting hydraulic cylinders with rams which protrude from one end of the cylinder only. The protruding rams are axially aligned with the main pistons of the pumps to which they are stoutly connected. These ram-and-cylinder, double-acting driving units are hereinafter referred to as the actuators.

The actuators are unsymmetrical in that the operating area in the driving direction is greater than that in the retracting direction. The rams of the hydraulic actuators are therefore subjected to large compressive forces during the driving strokes and to a small tensile loads during retraction. The repeated application of the large compressive force has to be reflected in substantial design. However, the area in the retracting direction is sufficiently large to give the actuators a propensity for relatively fast retraction which is advantageous since this allows one actuator to dwell in the primed condition for a short time and to take up its delivery stroke at the instant the other reaches its prescribed limit. This minimises the possibility of delivery pressure transients associated with the two element system.

One important application of the invention is to provide means by which jet cleaning and cutting operations may be carried out at a point remote from the primary source of power without the hazards of transmitting the very high pressure cleaning or cutting fluid over a large distance and the associated head losses. This is particularly relevant to offshore and underwater applications generally.

In this application, a prime mover, usually but not invariably a diesel engine, is mounted and arranged to provide driving means for a mechanism for pumping a chosen power transmission fluid at moderate pressures. The mechanism would typically be a conventional hydraulic pump working on a conventional oily fluid. The prime mover, hydraulic pump, connecting drive, fuel and fluid supplies and auxiliaries forming the input assembly are arranged so that hydraulic fluid may be delivered at a rate which is selectable either at the input assembly or remotely. The complete input assembly delivering hydraulic fluid is constructed as a unit for purposes of transportation and is known as the power pack.

The power pack delivers hydraulic fluid, at relatively normal pressures (about 300 bar) into one or more pipes, usually flexible, which convey it to hydraulic actuators, as hereinbefore described. At the hydraulic actuators, the energy in the hydraulic fluid in converted into energy at very high pressure in the low viscosity working liquid used for cleaning or cutting, by means of high pressure piston pumps according to the invention. The hydraulic fluid is then returned via a pipe or pipes to the hydraulic power pack.

BRIEF DESCRIPTION OF THE DRAWINGS

In order to particularly describe the invention and the method by which it is to be performed, specific embodiments of the invention are hereinafter described, by way of example, with reference to the accompanying drawings, in which.

BEST MODES FOR CARRYING OUT THE INVENTION

Figure 1:
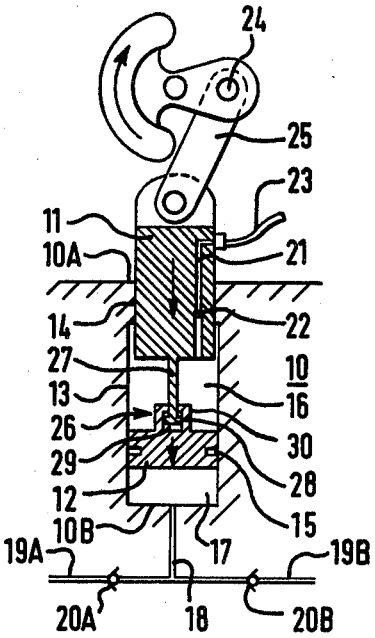
FIG. 1 is a schematic sectional elevation of a water pump assembly incorporating a high pressure piston pump according to the invention.

As shown in FIG. 1, a cylinder 10 having an open end 10A is fitted with main and subsidiary reciprocable pistons 11 and 12 which are reciprocable in a straight bore 13 and interconnected by lost motion coupling means 26. The main piston 11 and the bore 13 are provided with a controlled clearance seal 14 at the open end of the cylinder 10. The subsidiary piston 12 and the bore 13 are provided with piston ring sealing means 15.

As shown, the subsidiary piston 12 divides the cylinder 10 into first and second, variable volume chambers 16 and 17, respectively provided adjacent the main piston 11 and adjacent the head end 10B of the cylinder 10. The head end 10B of the cylinder 10 is connected by means of a conduit 18 to inlet and outlet ends 19A and 19B of a supply line for the working liquid, in this case water, to be pumped. The inlet and outlet ends 19A and 19B are respectively provided with non-return valves 20A and 20B which are arranged so as to permit water, at a pressure insufficient to cause upward movement of the subsidiary piston 12, to flow through the inlet end 19A of the supply line into the second chamber 17 when the subsidiary piston 12 moves upwardly and to flow from the second chamber 17 through the outlet end 19B of the supply line when the subsidiary piston 12 moves downwardly. The first chamber 16 is filled with an operating liquid, in this case oil, having a viscosity greater than that of water and an oil supply conduit 21 is formed in the main piston 11 and provided with a non-return valve 22. The conduit 21 is connected to a source of oil pressurised to about 30 bars, as shown schematically, by the flexible oil line 23.

The main piston 11 is provided with reciprocating means, schematically illustrated as a rotary crank shaft 24 and connecting rod 25. On downward movement of the main piston 11, the oil displaced by the main piston 11 causes the subsidiary piston 12 to eject water from the second chamber 17.

Where the pressure of this discharged water is to be as high as 3,000 bars, it is clear that the oil in the first chamber 16 is also at a similar pressure and so the piston ring sealing means 15 are quite adequate to prevent the flow of water into the first chamber 16 and the flow of oil into the second chamber 17. However, although the controlled clearance seal 14 is adequate to prevent excessive leakage of a liquid having a high viscosity, such as oil, even at pressures as high as 3,000 bars, it is inevitable that there will be some leakage of oil during each pressure stroke of the pump. This means that the volume swept by the main piston 11 is always more than the volume swept by the subsidiary piston 12. However, as shown in FIG. 1, the coupling 26 consists of a spindle 27 projecting downwardly from the bottom end of the main piston 11 and having an enlarged head 28. This enlarged head 28 is located within an internally shouldered recess 29 formed in a bracket 30 on the subsidiary piston 12. The enlarged head 28 and the internal shoulders of the recess 29 thus constitute abutment means for limiting relative movement of the subsidiary piston 12 away from the main piston 11. Although the coupling 26 permits lost motion in that the main piston 11 can move towards the subsidiary piston 12 as a result of leakage of oil from the first chamber 16 as the main piston 11 moves towards the head end 10B of the cylinder 10, and can move away from the subsidiary piston 12 when the main piston 11 moves away from the head end 10B of the cylinder 10, this relative movement of the main piston 11 away from the subsidiary piston 12 is limited by engagement between the enlarged head 28 and the internal shoulders of the recess 29. Moreover, as soon as the pressure of the oil in the first chamber 16 falls below 30 bars, oil is able to flow into the first chamber 16 through the oil supply conduit 21, past the non-return valve 22. This ensures that there is a full charge of oil in the first chamber 16 for the next pressure stroke of the main and subsidiary pistons 11 and 12.

Figure 2:
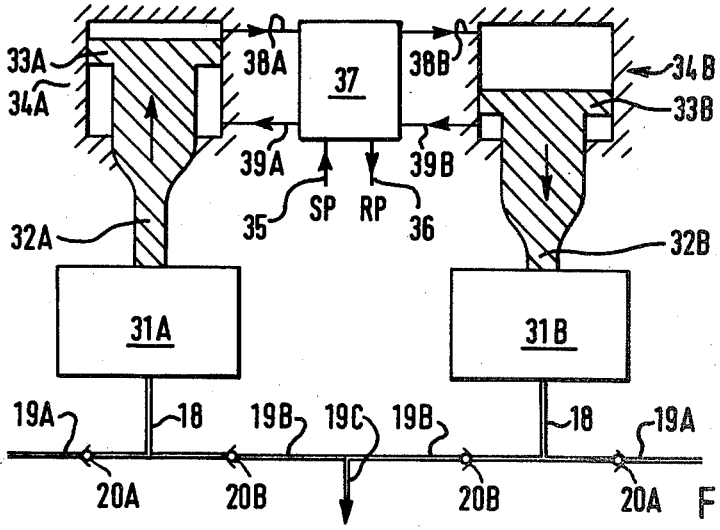
FIG. 2 is a schematic sectional elevation of a high pressure piston pump assembly, according to the invention, in which a hydraulic actuating liquid is used to pump a second working liquid.

In the high pressure piston pump assembly illustrated in FIG. 2, there are two high pressure piston-cylinder pumps 31A and 31B constructed in accordance with the high pressure piston pumps incorporated in the assembly illustrated in FIG. 1. Each piston-cylinder pump is connected by means of a conduit 18 to a water supply line having inlet and outlet ends 19A and 19B respectively provided with non-return valves 20A and 20B. The outlet ends 19B of the two water supply lines are connected to a common outlet 19C.

Both piston-cylinder pumps 31A and 31B have pistons (not shown) which are connected by connecting rods 32A and 32B to double-acting rams 33A and 33B of two hydraulic actuators 34A and 34B which drive the piston-cylinder pumps 180° out of phase.

The hydraulic actuators 34A and 34B are connected to a source (not shown) of pressurised hydraulic actuating liquid by means of supply and return lines 35 and 36 and valve means 37. As shown, the valve means 37 connect the supply line 35 to the upper transfer line 38B and the lower transfer line 39A and connect the return line 36 to the upper transfer line 38A and the lower transfer line 39B. Thus, the upper and lower ends of the double-acting ram 33B are subjected, respectively, to the supply and return pressures SP and RP, so as to drive the ram 33B downwardly, as shown, whereas the supply and return pressures SP and RP are applied, respectively, to the lower and upper ends of the double-acting ram 33A so as to effect a return stroke of this ram 33A.

Figure 3:
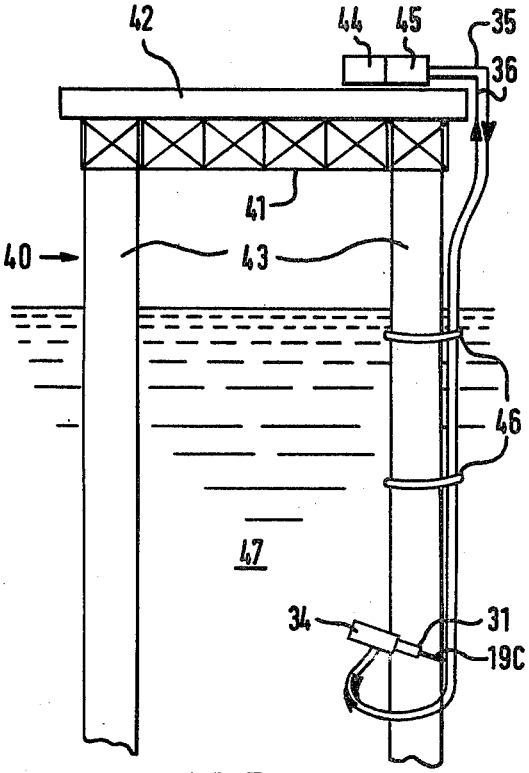
FIG. 3 is a schematic layout of a complete system from prime mover to a jet cleaning or cutting gun.

FIG. 3 shows the upper part of an offshore oil rig 40 in which a superstructure 41, supporting a working platform 42, is mounted on legs 43 (only partly shown). A prime mover 44 is jointly mounted on the platform 42 with a hydraulic pumping mechanism 45 having supply and return lines 35 and 36. These lines 35 and 36 are belayed to one of the legs 43 by means of removable straps 46 and terminate at two hydraulic actuators 34 (34A and 34B) which are jointly mounted in a mobile unit with two high pressure piston pumps 31 (31A and 31B) supplying pressurised sea water 47 to a common outlet 19C in the form of a cleaning nozzle.

Thus, by operating the power pack including the prime mover 44 and the hydraulic pumping mechanism 45 so as to provide a supply of hydraulic actuating liquid at a moderate pressure, such as 5,000 psi, the mobile unit can provide a jet of sea water at very high pressure, such as 25,000 psi, for removing marine growths and other material fouling the under water surfaces of the oil rig 40.

I claim:

1. A high pressure piston pump, in which a working liquid supplied at a first pressure is delivered at a second, ultra-high pressure, comprising:

a cylinder having a first, open end and an opposite head end;

a main piston drivably reciprocable within said first, open end of the cylinder;

a subsidiary piston disposed between the main piston and the opposite, head end of the cylinder;

a first variable volume chamber in said cylinder, between said main piston and said subsidiary piston;

a conduit provided with non-return means for supplying a pressurised operating liquid to said first chamber whenever the pressure in the first chamber falls below an intermediate pressure between said first pressure and said second, ultra-high pressure;

a second variable volume chamber in said cylinder, between said subsidiary piston and said head end of the cylinder;

supply valve means for the supply of working liquid to said second chamber at said first pressure;

discharge valve means for the discharge of working liquid from the second chamber at said second, ultra-high pressure;

first and second sealing means respectively provided between the main piston and the open end of the cylinder and between the subsidiary piston and the bore of the cylinder for controlling leakage of the operating liquid from the cylinder and for restricting flow of the operating and working liquids between the subsidiary piston and the bore of the cylinder, respectively; and lost motion coupling means for connecting the main and subsidiary pistons for permitting the main piston to move towards the subsidiary piston, by a distance which is a small fraction of the stroke of the main piston, as a result of leakage of operating liquid past the first sealing means when the main piston moves towards the head end of the cylinder and to move away from the subsidiary piston, by a limited amount, during movement of the main piston away from the head end of the cylinder.

2. A pump, according to claim 1, wherein said conduit extends through the main piston for supplying operating liquid to the first chamber.

3. A high-pressure-liquid, under-water cleaning installation, for cleaning surfaces immersed in water by means of a jet of water at ultra-high pressure, said installation comprising:

two high-pressure piston pumps, in which a working liquid supplied at a first pressure is delivered at a second, ultra-high pressure;

hydraulic actuator means operatively connected to said high pressure piston pumps for operating said pumps 180° out of phase with each other so that, in use of the installation, when the pumps and the actuator means are immersed in water, the water serves as the working liquid;

supply and return hydraulic lines communicatively connected to said hydraulic actuator means;

a prime mover;

a hydraulic pumping mechanism drivingly connected to the prime mover and communicatively connected to the supply and return hydraulic lines;

each high-pressure piston pump comprising:

a cylinder having a first open end and an opposite head end;

a main piston drivably reciprocable within said first, open end of the cylinder;

a subsidiary piston disposed between the main piston and the opposite, head end of the cylinder;

a first variable volume chamber in said cylinder, between said main piston and said subsidiary piston;

a conduit provided with non-return means for supplying a pressurised operating liquid to said first chamber whenever the pressure in the first chamber falls below an intermediate pressure between said first pressure and said second, ultra-high pressure;

a second variable volume chamber in said cylinder, between said subsidiary piston and said head end of said cylinder;

supply valve means for the supply of working liquid to said second chamber at said first pressure;

discharge valve means for the discharge of working liquid from the second chamber at said second, ultra-high pressure;

first sealing means provided between the main piston and the open end of the cylinder for controlling leakage of the operating liquid from the cylinder;

second sealing means provided between the subsidiary piston and the bore of the cylinder for restricting flow of the operating and working liquids between the subsidiary piston and the bore of the cylinder; and lost motion coupling means for connecting the main and subsidiary pistons so as to permit the main piston to move towards the subsidiary piston, by a distance which is a small fraction of the stroke of the main piston, as a result of leakage of operating liquid past the first sealing means when the main piston moves towards the head end of the cylinder and to move away from the main piston, by a limited amount, during movement of the main piston away from the head end of the cylinder.

4. A high-pressure-liquid, under-water cleaning installation, according to claim 3, in which the conduit provided with the non-return means is communicatively connected to the hydraulic supply line for the supply of pressurised operating liquid to the first chamber from the hydraulic pumping mechanism.

* * * * *